US007025128B2

(12) United States Patent
Kamiyama et al.

(10) Patent No.: US 7,025,128 B2
(45) Date of Patent: Apr. 11, 2006

(54) COMPOUND TYPE HEAT EXCHANGER

(75) Inventors: Naohisa Kamiyama, Ashikaga (JP); Toshiharu Watanabe, Sano (JP)

(73) Assignee: Calsonic Kansei Corporation, Tokyo (JP)

( * ) Notice: Subject to any disclaimer, the term of this patent is extended or adjusted under 35 U.S.C. 154(b) by 3 days.

(21) Appl. No.: 10/842,151

(22) Filed: May 10, 2004

(65) Prior Publication Data

US 2005/0006080 A1 Jan. 13, 2005

(30) Foreign Application Priority Data

May 15, 2003 (JP) ..... P2003-137639

(51) Int. Cl.
*F28F 9/02* (2006.01)

(52) U.S. Cl. ..... 165/174; 165/140; 165/152

(58) Field of Classification Search ..... 165/140, 165/151, 153, 174, 176
See application file for complete search history.

(56) References Cited

U.S. PATENT DOCUMENTS 2,037,845 A * 4/1936 Young ..... 165/139
2,264,820 A * 12/1941 Young ..... 165/140
2,505,790 A * 5/1950 Panthofer ..... 165/140
5,690,166 A * 11/1997 Yamaguchi ..... 165/174
6,035,927 A * 3/2000 Krauss et al. ..... 165/152
6,394,176 B1 * 5/2002 Marsais ..... 165/140
6,510,893 B1 * 1/2003 Naji et al. ..... 165/153
2002/0040776 A1 * 4/2002 Kokubunji et al. ..... 165/140

FOREIGN PATENT DOCUMENTS

JP 2000-018880 1/2000
WO WO 82/04307 * 12/1982

* cited by examiner

*Primary Examiner*—Teresa J. Walberg
(74) *Attorney, Agent, or Firm*—Kilpatrick Stockton LLP

(57) ABSTRACT

A compound type heat exchanger has a core part including a plurality of heat exchanging pipes and fins juxtaposed and alternately stacked into a lamination. Header pipes are connected to both ends of the pipes. Partition walls are provided in the header pipes. At a boundary of the partition wall and a spatial part, the core part is divided into two parts providing an oil cooler unit on one hand and a condenser unit on the other hand. The spatial part is defined in the core part, corresponding to the intermediate portion between the partition walls in the header pipe. Owing to the provision of the spatial part in the core part, heat conduction from the oil cooler unit to the condenser unit can be suppressed.

2 Claims, 6 Drawing Sheets

COMPOUND TYPE HEAT EXCHANGER

BACKGROUND OF THE INVENTION

The present invention relates to a compound type heat exchanger having a plurality of independent heat exchanging units, such as condenser and oil cooler, integrated with each other.

Normally, an automobile is equipped with some heat exchanging units, for example, a radiator for cooling an engine, an air conditioning condenser, an oil cooler for cooling automatic transmission oil (i.e. ATF oil cooler), an oil cooler for cooling engine oil and so on. Hitherto, the above radiator and the condenser are individually arranged in the front area of an engine. Recently, in view of reducing the installation space of such units for purpose of the downsizing of an engine and also reducing the number of assembling steps of the units, a compound type heat exchanger where a condenser and an oil cooler are integrated in one body has been developed.

In the compound type heat exchanger, however, there is a great difference in temperature between a heat exchanging medium flowing the condenser and oil flowing the oil cooler. Therefore, Japanese Patent Application Laid-open No. 2000-18880 discloses a compound type heat exchanger provided, between a condenser and an oil cooler, with a pseudo heat exchanging passage member in which such a heat exchanging medium does not flow.

In the above-mentioned compound type heat exchanger, however, fins are connected to both sides of the pseudo heat exchanging passage member by means of brazing. Therefore, there is a possibility that heat of oil flowing the oil cooler is transmitted to the heat exchanging medium flowing the condenser to deteriorate the heat exchanging efficiency of the heat exchanger.

SUMMARY OF THE INVENTION

In the above-mentioned situation, it is an object of the present invention to provide a compound type heat exchanger having a plurality of heat exchanging units, which can suppresses heat conduction from the heat exchanging unit of high temperature to the heat exchanging unit of low temperature.

In order to attain the above object, the present invention provides A compound type heat exchanger, comprising: a core part having a plurality of heat exchanging tubes each formed to allow passage of a heat exchanging medium therein, the heat exchanging tubes being juxtaposed to each other, and a plurality of fins each interposed between the adjoining heat exchanging tubes so that the heat exchanging tubes and the fins are laminated alternately; a pair of header pipes arranged on both ends of the heat exchanging tubes and also connected to respective ends of the heat exchanging tubes; and partition walls each arranged in the header pipes thereby to divide spaces inside the header pipes in a direction perpendicular to a longitudinal direction of the header pipes, wherein the core part defines a spatial part extending in a direction perpendicular to a longitudinal direction of the header pipes at a position corresponding to the partition walls, wherein the core part and the header pipes are divided at a boundary of the spatial part into a first heat exchanging unit and a second heat exchanging unit.

With the above-mentioned constitution, since the spatial part is defined in the core part by eliminating a specified heat exchanging tube arranged at a position corresponding to the partition walls, heat conduction between the first heating exchanging unit and the second heat exchanging unit is remarkably reduced to maintain high heat exchanging performance of the whole heat exchanger.

In a preferred embodiment, the partition wall are arranged apart from each other in each of the header pipes, and the spatial part is defined in the core part, at the position corresponding to an intermediate position between the partition walls apart from each other in each of the header pipes.

With the above-mentioned constitution, since the plural partition walls are apart from each other in the longitudinal direction of each header pipe, the heat conduction between the heat exchanging mediums flowing in the header pipe is reduced to enhance the effect of the heat exchanger furthermore.

These and other objects and features of the present invention will become more fully apparent from the following description and appended claims taken in conjunction with the accompany drawings.

DETAILED DESCRIPTION OF THE PREFERRED EMBODIMENT

Referring to accompanying drawings, an embodiment of the present invention will be described below.

Figure 1:
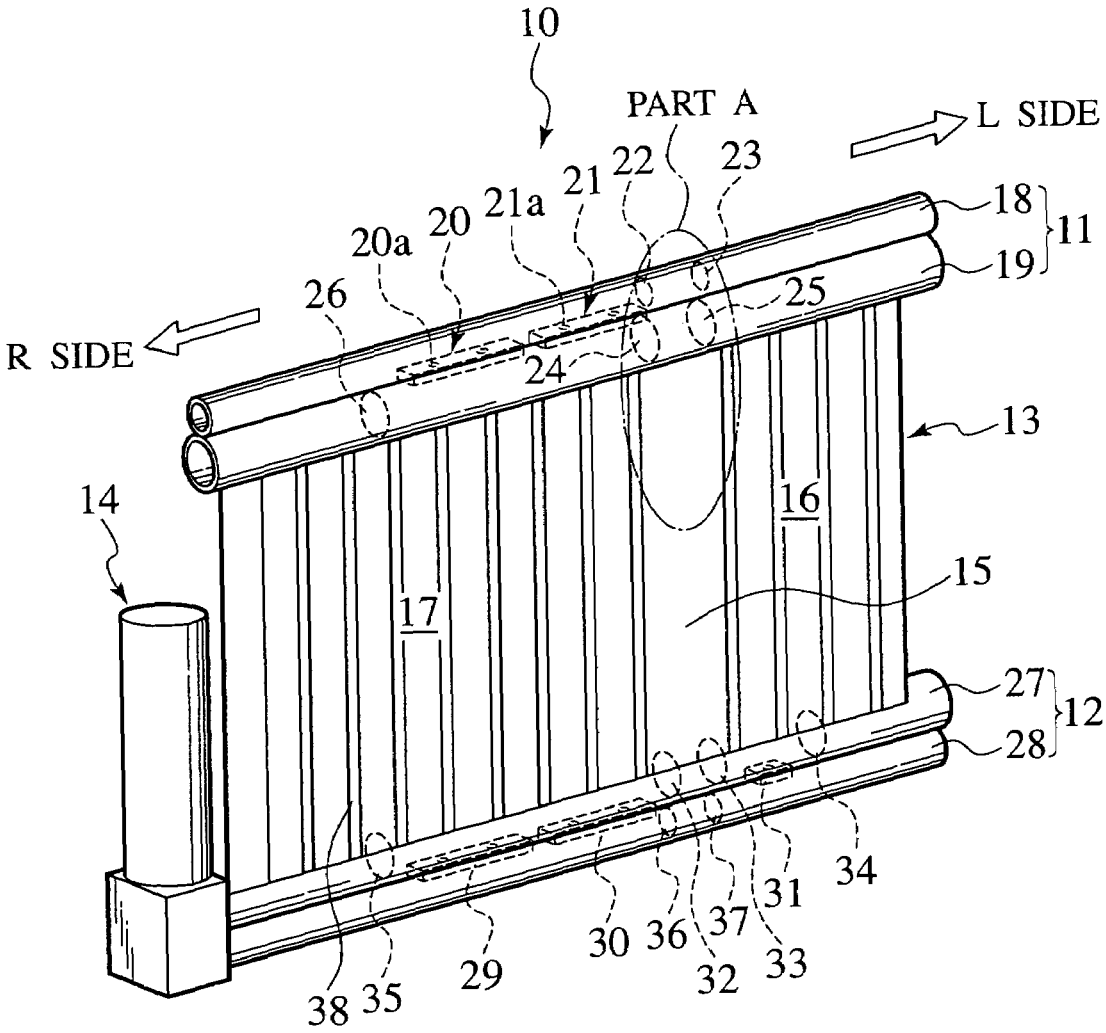
FIG. 1 is a perspective view of a heat exchanger in accordance with an embodiment of the present invention.

FIG. 1 is a perspective view of a compound type heat exchanger 10 in accordance with the first embodiment of the present invention. As shown in this figure, the heat exchanger 10 of this embodiment includes an upper header pipe 11 on the upper side, a lower header pipe 12 on the lower side, a core part 13 connecting the upper header pipe 11 with the lower header pipe 12 in the vertical direction and a liquid tank 14 connected to the lateral side of the lower header pipe 12. In FIG. 1, fins are eliminated in order to exhibit the constitution of the heat exchanger 10 clearly. A heat exchanger's part on the left side ("L" side shown in FIG. 1) of a spatial part constitutes an oil cooler unit 16 (as the first heat exchanging unit), while another heat exchanger's part on the right side ("R" side shown in FIG. 1) of the spatial part 15 constitutes a condenser unit 17 (as the second heat exchanging unit). The condenser unit 17 serves to cool a cooling medium for air conditioning cycle, while the oil cooler unit 16 cools a transmission oil for an automatic car.

The upper header pipe 11 has an upper pipe 18 and a lower pipe 19 both of which are adjacent to each other in the vertical direction. The upper pipe 18 is communicated with the lower pipe 19 through joint members 20, 21 having a plurality of through-holes 20*a*, 21*a*, respectively. The upper pipe 18 is closed up by two disk-shaped partition walls 22, 23 positioned in the way of the pipe 18 in the longitudinal direction. These partition walls 22, 23 are apart from each other. Similarly, the lower pipe 19 is provided, therein, with partition walls 24, 25 at respective positions corresponding to the partition walls 22, 23 of the upper pipe 18. The lower pipe 19 further includes one partition wall 26 closer to the liquid tank 14. The above joint member 20, 21 are arranged between the partition wall 24 and the partition wall 26.

Similarly to the upper header pipe 11, the lower header pipe 12 is formed by an upper pipe 27 and a lower pipe 28 both of which are adjacent to each other. The upper pipe 27 is communicated with the lower pipe 28 through joint members 29, 30 and 31. Further, partition walls 32-37 are arranged in the pipes 27, 28, as shown in the figure. Juxtaposed in the core part 13 are a plurality of heat exchanging tubes 38 that extend vertically and allow the heat exchanging medium to flow therein. Each of corrugated fins (see FIG. 2) is arranged between the adjoining heat exchanging tubes 38. Noted that not only the partition walls 32, 33 but the partition walls 36, 37 are apart from each other at a distance generally equal to the distance between the partition wall 22 and 23.

Figure 2:
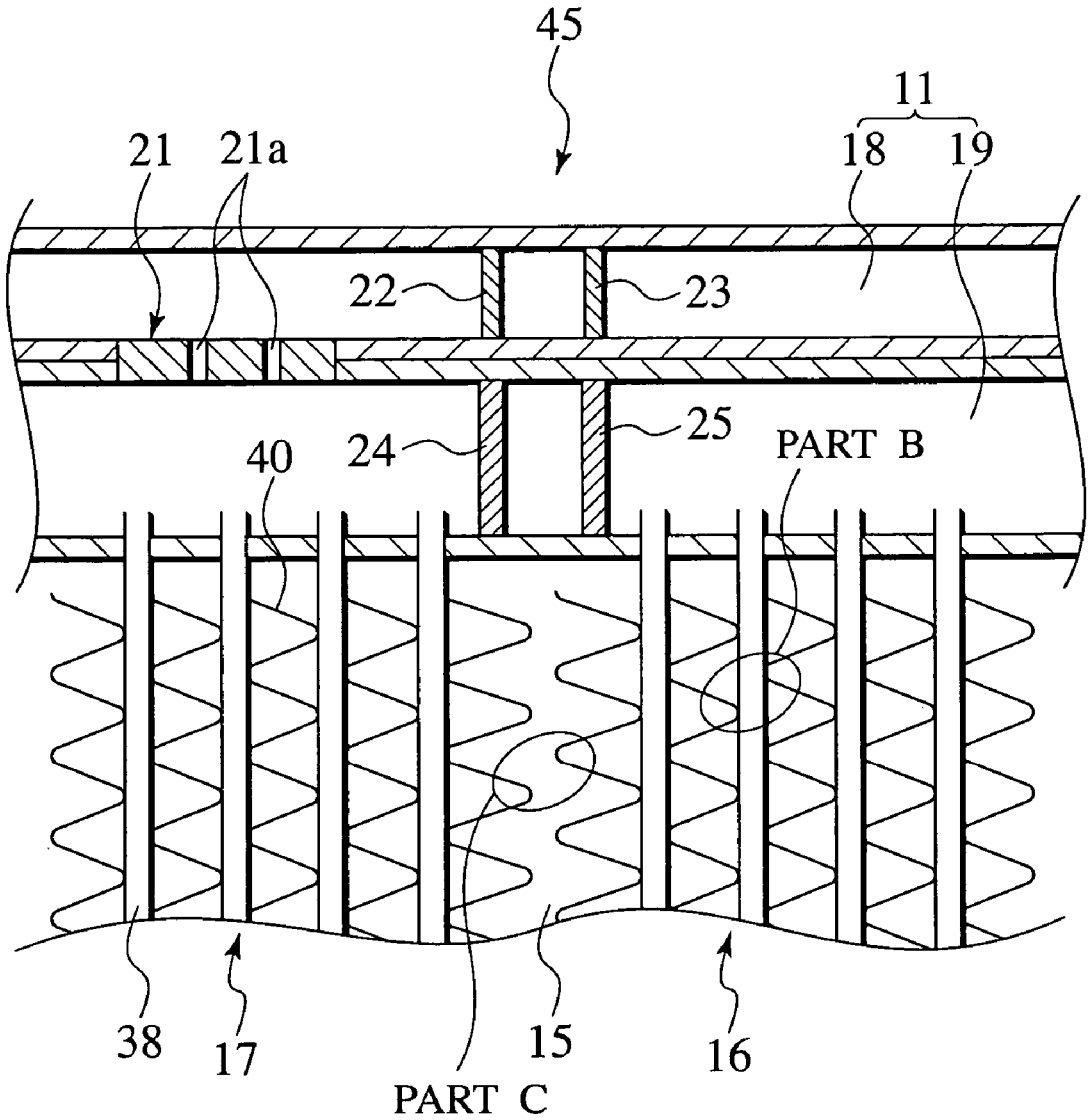
FIG. 2 is a sectional view of a part A of FIG. 1 in enlargement.

FIG. 2 is an enlarged sectional view of a part A of FIG. 1. As mentioned above, the upper and lower pipes 18, 19 are provided with the partition walls 22–25. Defined below the substantial middle points between the opposing partition walls 22 and 23 and also between the opposing partition walls 24 and 25 is a spatial part 15 that can be obtained by eliminating one heat exchanging tube 38 in the core part 13. Having a width W (FIG. 4), the spatial part 15 is arranged at the boundary dividing the core part 13 into the condenser unit 17 and the oil cooler unit 16. The width W of the spatial part 15 is generally equal to the diameter of the heat exchanging tube 38.

Figure 3:
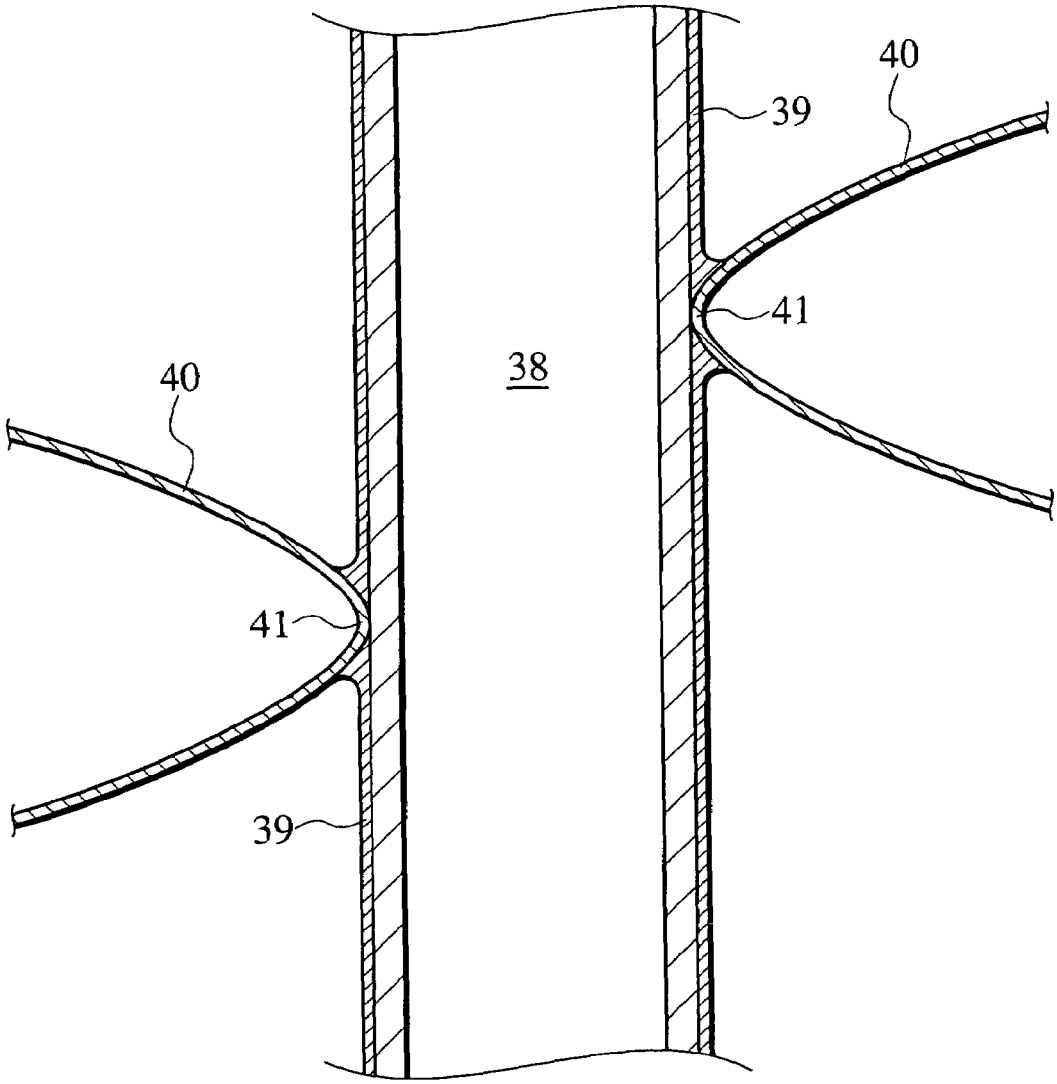
FIG. 3 is a sectional view of a part B of FIG. 2 in enlargement.

As shown in FIG. 3, each of the heat exchanging tubes 38 has a hollow interior and its outer surface coated with a cladding layer 39 made of a brazing material, through which the fins 40 are joined to the tube 38. In assembling, respective peaks 41 of the fins 40 abut on the cladding layer 39 of the brazing material (e.g. aluminum alloys) on the outer surface of the heat exchanging tube 39. In this state, by heating the whole heat exchanger, only the cladding layer 39 is molten, so that the fins 40 are joined to each of the tubes 38 by brazing.

Figure 4:
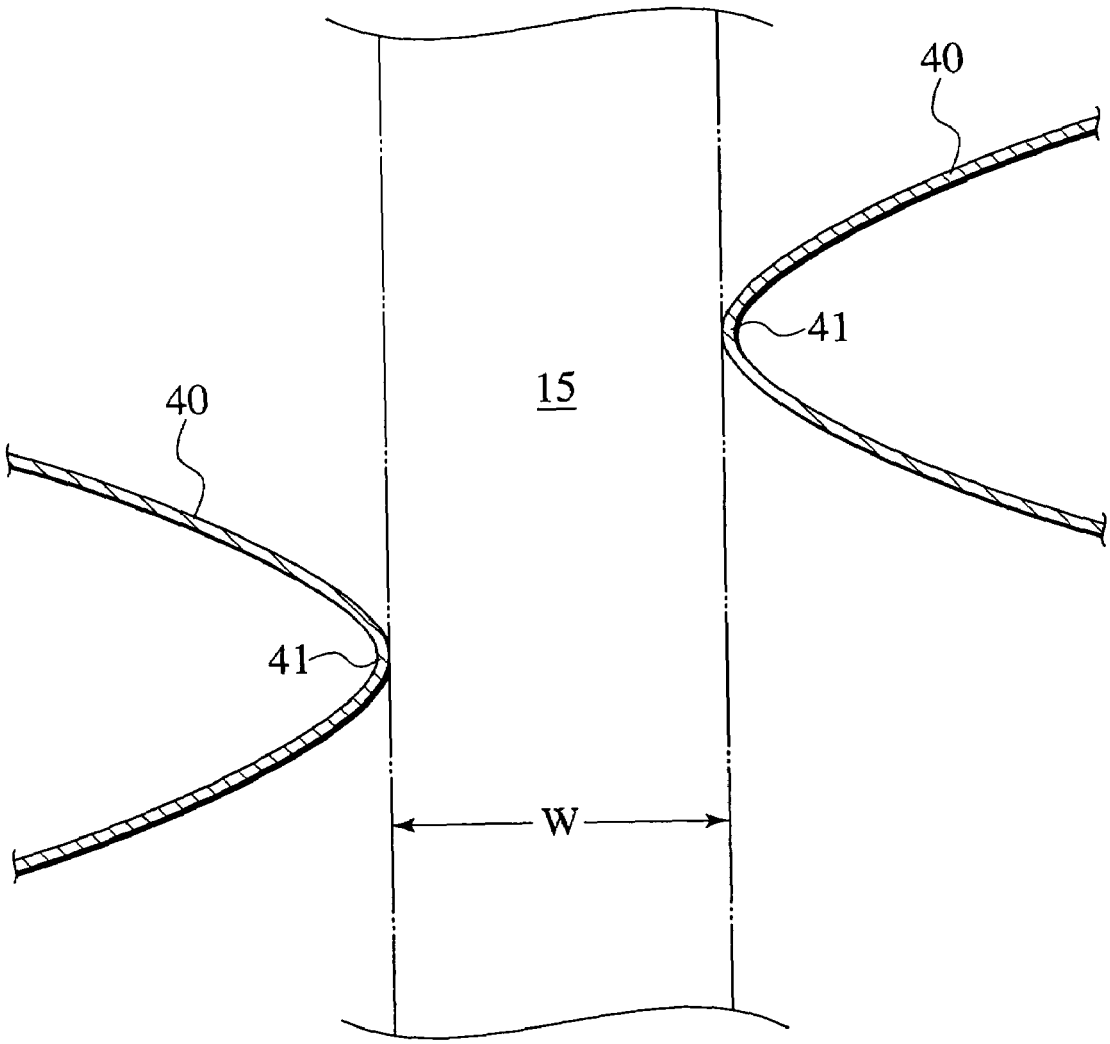
FIG. 4 is a sectional view of a part C of FIG. 2 in enlargement.

Meanwhile, as shown in FIG. 4 as a result of enlarging a part C of FIG. 2, it is noted that the left and right fins 40 on both sides of the spatial part 15 are arranged apart from each other at an interval equal to the above-mentioned width W of the spatial part 15.

Next, the manufacturing order of the heat exchanger 10 of the embodiment will be described in brief.

Figure 5:
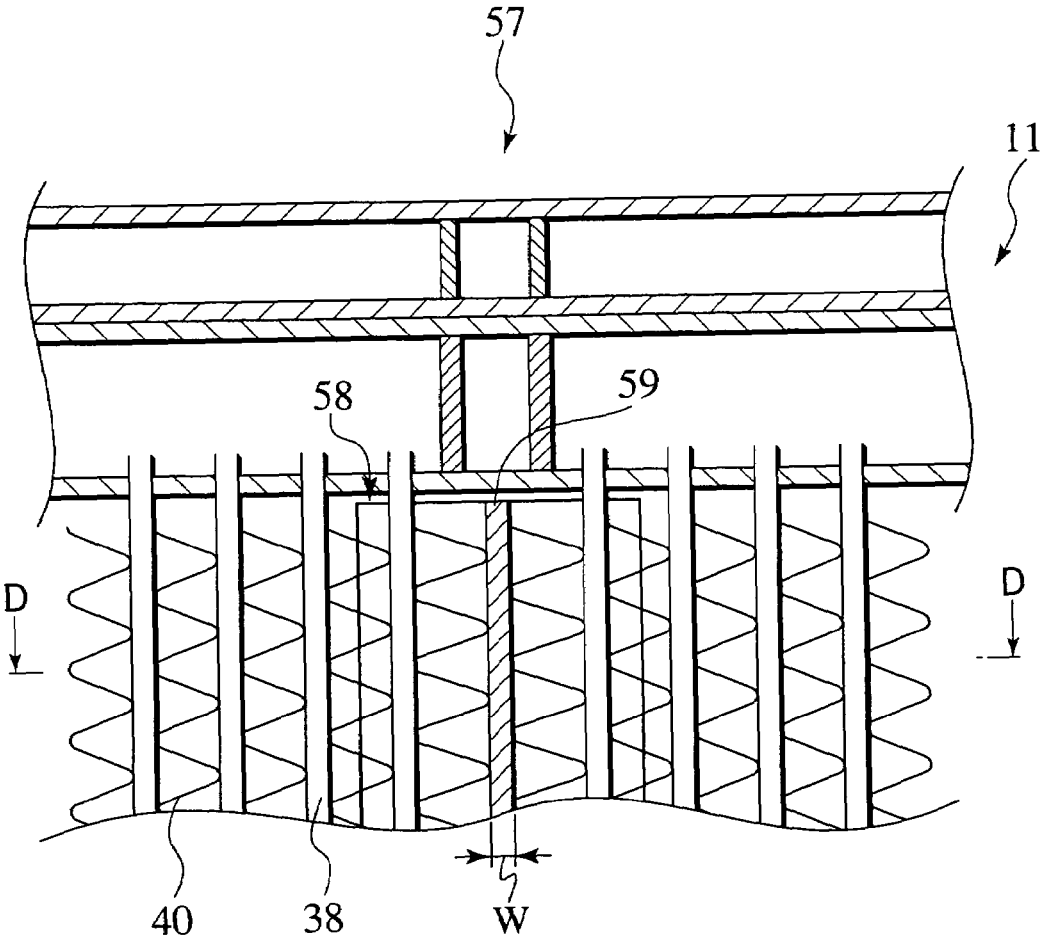
FIG. 5 is a sectional view showing a midway stage of the production of the heat exchanger of the embodiment.
Figure 6:
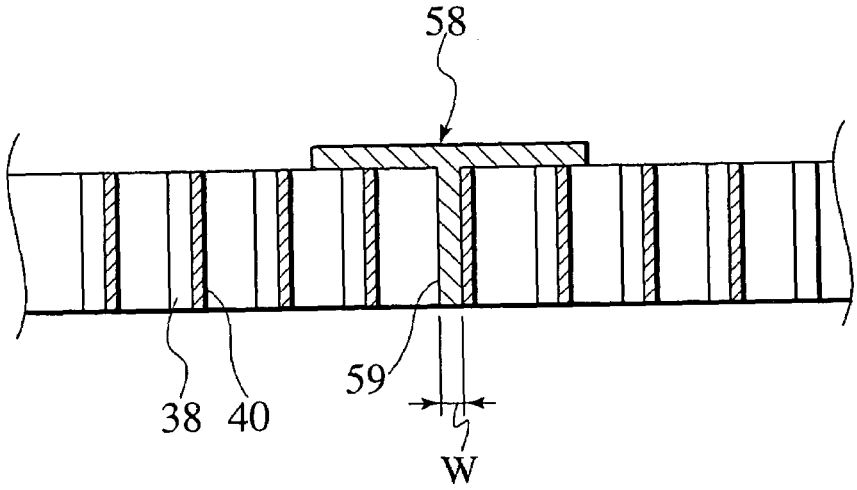
FIG. 6 is a sectional view taken along a line D—D of FIG. 5.

As shown in FIG. 5, it is first performed to laminate the heat exchanging tubes 38 and the fins 56 alternately. Then, at a half-way position in such a lamination, it is carried out to interpose a brazing jig 58 having a substantial T-shaped section between two fins 40, 40. After the interposition of the brazing jig 58, it is started again to laminate the heat exchanging tubes 38 and the fins 56 alternately. Here, it is noted that the brazing jig 58 is provided with a leg 59 of thickness W. In this state, the whole heat exchanger is heated up and thereafter, the brazing jig 57 is removed from the heat exchanger. As a result, a gap of thickness W is produced between the opposing fins 40 and 40, in place of the leg 59 of the brazing jig 58. For the brazing jig 58, it is preferable to employ a jig that would not be jointed with a cladding layer of a brazing material, for example, jig excluding aluminum alloy, jig coated with a predetermined material, etc.

Figure 7:
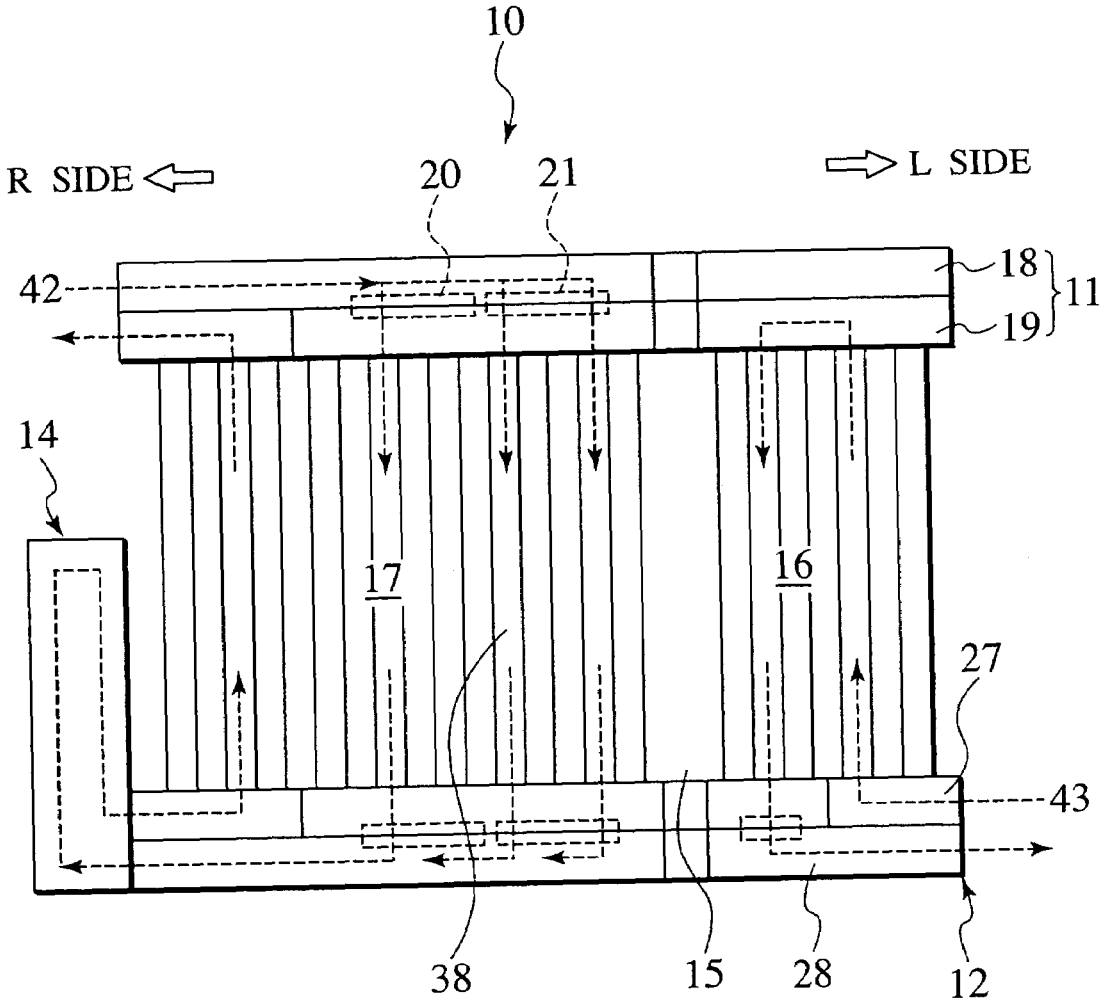
FIG. 7 is a perspective view showing the flows of medium and oil in the heat exchanger of the embodiment.

Referring to FIG. 7, the flows of a medium 42 and oil 43 in the heat exchanger 10 of the embodiment will be described. In FIG. 7, the above-mentioned fins 40 are eliminated in order to clarify such flows of the medium 42 and the oil 43.

As shown in the figure, in the condenser unit 17 on the "R" side of the figure (i.e. the right side in the traveling direction), the medium 42 flowing into the upper pipe 18 of the upper header pipe 11 passes through the joint members 20, 21 and the lower pipe 19 and successively flows in the heat exchanging pipes 38 downwardly. Subsequently, the medium 42 flows from the lower header pipe 12 to the liquid tank 14 and thereafter, the medium 42 flows in the heat exchanging pipes 38 upwardly. After that, the medium 42 is returned to an air-conditioning cycle through the lower pipe 19 of the upper header pipe 11.

On the other hand, in the oil cooler unit 16 on the "L" side of the figure (i.e. the left side in the traveling direction), the oil 43 entering from the upper pipe 27 of the lower header pipe 12 flows in the heat exchanging tubes 38 upwardly and turns back at the lower pipe 19 of the upper header pipe 11. Subsequently, after flowing in the heat exchanging pipes 38 downwardly, the oil is returned to a transmission through the lower pipe 28 of the lower header pipe 12. Noted that the temperature of the medium 42 flowing the condenser unit 17 is about 60° C., while the temperature of the oil flowing the oil cooler unit 16 is about 110° C. being a remarkable high temperature.

According to the heat exchanger 10 of the first embodiment, owing to the provision of the spatial part 15 between the oil cooler unit 16 and the condenser unit 17, there is almost no heat conduction from the oil cooler unit 16 of high temperature to the condenser unit 17 of relatively how temperature, whereby the heat exchanging performance of the heat exchanger 10 as a whole can be maintained. Noted that, in the conventional heat exchanger, there is a possibility of heat conduction from an oil cooler unit of high temperature to a condenser unit through the intermediary of a pseudo heat exchanging passage member because the pseudo heat exchanging passage member is welded to fins on respective sides of the oil cooler unit 16 and the condenser unit 17. While, in accordance with the heat exchanger 10 of this embodiment, the quantity of heat conduction from the oil cooler unit 16 and the condenser unit 17 can be remarkably reduced.

Finally, it will be understood by those skilled in the art that the foregoing descriptions are nothing but one embodiment of the disclosed heat exchanger and therefore, various changes and modifications may be made within the scope of claims.

What is claimed is:

1. A compound type heat exchanger, comprising:

a core part including a first heat exchanging unit, a second heat exchanging unit and a spatial part, wherein each of the heat exchanging units includes a plurality of tubes and a plurality of fins which are interposed between the heat exchanging tubes, and wherein the spatial part corresponds to an opening between one of the fins of the first heat exchanging unit and one of the fins of the second heat exchanging unit; and a pair of header pipes arranged at both ends of the heat exchanging tubes and connected to the respective ends of the heat exchanging tubes, the header pipes including partition walls to divide spaces inside the header pipes.

2. The compound type heat exchanger of claim 1, wherein the partition walls are arranged apart from each other in each of the header pipes, and the spatial part is arranged in the core part at its position corresponding to an intermediate position between the partition walls apart from each other in each of the header pipes.

* * * * *